United States Patent [19]

Strenger

[11] Patent Number: 4,759,472

[45] Date of Patent: Jul. 26, 1988

[54] CONTAINER HAVING A PRESSURE-RUPTURABLE SEAL FOR DISPENSING CONTENTS

[75] Inventor: Marshall C. Strenger, Lake Forest, Ill.

[73] Assignee: Hays MacFarland & Associates, Glen Ellyn, Ill.

[21] Appl. No.: 14,622

[22] Filed: Feb. 13, 1987

Related U.S. Application Data

[63] Continuation-in-part of Ser. No. 854,728, Apr. 17, 1986, abandoned, which is a continuation of Ser. No. 691,380, Jan. 13, 1985, abandoned, which is a continuation of Ser. No. 535,364, Sep. 23, 1983, abandoned.

[51] Int. Cl.[4] ..... B65D 35/00

[52] U.S. Cl. ..... 222/92; 222/541; 222/564; 206/634

[58] Field of Search ..... 222/107, 92, 94, 185, 222/491, 541, 547, 564; 206/219, 631, 634, 620, 629

[56] References Cited

U.S. PATENT DOCUMENTS

| | | | |
|---|---|---|---|
| 3,913,789 | 10/1975 | Miller | 222/107 |
| 3,964,604 | 6/1976 | Prenntzell | 206/219 |
| 4,163,510 | 8/1979 | Strenger | 222/129.2 |
| 4,322,019 | 3/1982 | Smith | 222/83.5 |
| 4,553,971 | 11/1985 | Ashley et al. | 604/415 |

FOREIGN PATENT DOCUMENTS

| | | | |
|---|---|---|---|
| 560381 | 9/1957 | Belgium | 222/107 |

*Primary Examiner*—Michael S. Huppert
*Attorney, Agent, or Firm*—Leydig, Voit & Mayer

[57] ABSTRACT

A sealed container of the type which is ruptured by the application of external pressure to dispense a substance package therein. The container comprises walls of flexible sheet material having mating peripheral edges formed with a marginal area seal to define a fluid type internal packaging compartment. The marginal area seal includes relatively strong permanently sealed areas which define an unsealed discharge spout, and an arcuate shaped relatively weakly sealed area surrounding the discharge spout for defining an unsealed chamber communicating with the discharge spout, whereby upon application of predetermined external pressure to the container, the weakly sealed area will rupture to permit the controlled discharge of the package substance through the unsealed chamber and discharge spout. A relatively strong permanently sealed diverter area is formed within the unsealed chamber defined by the arcuate seal and discharge spout for retaining the walls of the container together at such diverter area upon rupturing of the arcuate weakly sealed area and for metering the discharge of the package contents.

26 Claims, 1 Drawing Sheet

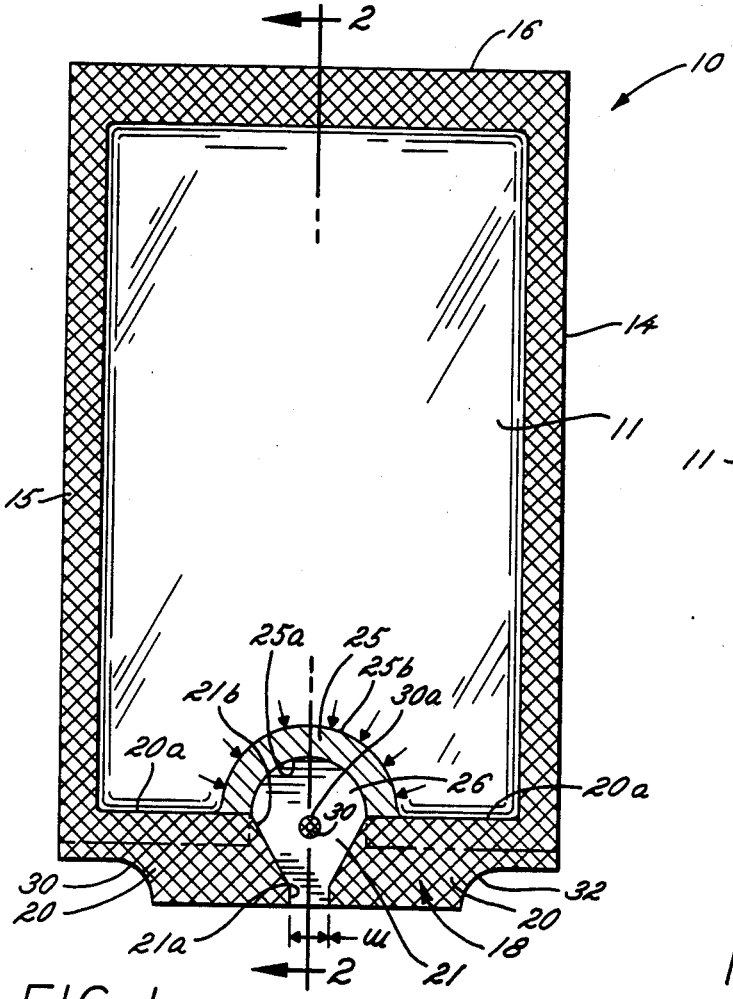
FIG. 1
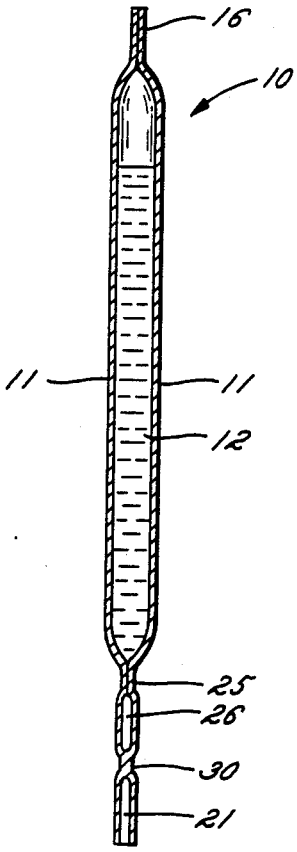
FIG. 2
FIG. 3
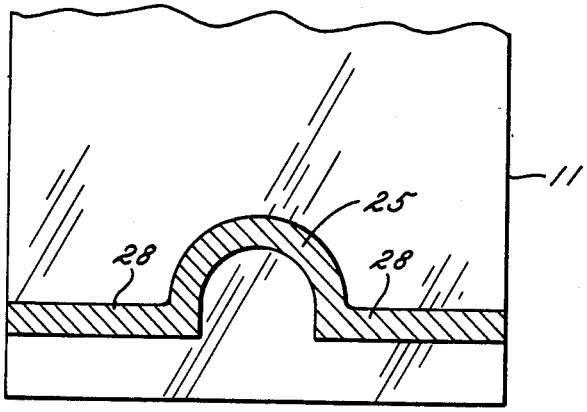
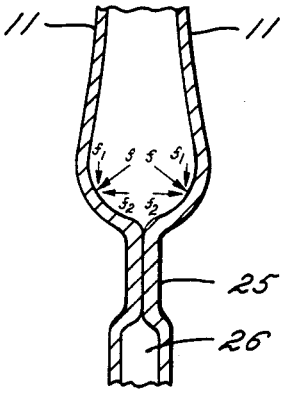
FIG. 4

CONTAINER HAVING A PRESSURE-RUPTURABLE SEAL FOR DISPENSING CONTENTS

RELATED APPLICATIONS

This application is a continuation-in-part of U.S. patent application Ser. No. 854,728, filed Apr. 17, 1986, now abandoned, entitled "Container Having a Pressure-Rupturable Seal for Dispensing Contents", which is a continuation of application Ser. No. 691,380 filed Jan. 13, 1985, now abandoned, which in turn is a continuation of U.S. application Ser. No. 535,364 filed Sept. 23, 1983, now abandoned.

A related application is application Ser. No. 014,927, entitled "Beverage Dispensing System" filed simultaneously with the present application.

DESCRIPTION OF THE INVENTION

The present invention relates generally to containers for liquids that are sealed about their perimeter in such a manner that the seal may be ruptured by the application of external pressure to the container to thereby dispense the contents, and more particularly, to a pressure rupturable container adapted for containing a measured quantity of a flavoring constituent for use in the automatic dispensing of carbonated soft drink beverages.

Carbonated beverage dispensers have long been available which permit the selection and dispensing of one of a plurality of flavors of beverages directly into a serving cup. Such dispensers, sometimes are referred to as "post-mix" dispensing systems, typically require large containers of the various syrups to be used as the flavoring constituents. The syrup containers, which must be refilled or replaced on a regular basis, are both messy to handle and create sanitary problems. Since each container must be independently coupled to the discharge location of the dispenser with separate control valving, such beverage dispenser systems are buly in size, duplicative and complex in construction, and expensive to maintain. Hence, such systems primarily have been employed in relatively high use commercial establishments.

To alleviate some of the problems of such postmix beverage dispensers, a system has been proposed which utilizes flavoring constituents sealed in individual serving packets, which are individually placed into the dispenser for automatic release of the contents therein when the dispenser is activated to serve a drink. Systems of this type are disclosed in U.S. Pat. No. 4,163,510 and in the above identified related application Ser. No. 014,927, entitled "Beverage Dispensing System" filed simultaneously with the present application. Such systems permit the selection of a variety of flavoring constituents without the duplication and complexity of equipment often required by many conventional postmix carbonated beverage dispensers.

In such packet type automatic beverage dispensing systems, however, problems can occur in effecting reliable rupturing of the packet and in directing the contents from the packet in a manner that permits thorough mixing in the dispensed drink. Since the packets preferably are made of flexible sheet material, difficulties can arise in supporting the packet in proper position in the dispensing unit with the discharge end disposed such that the contents are expelled in the proper direction. In addition, while it is desirable to apply sufficient pressure to the packet by mechanical actuating means to effect assured rupturing, the application of excessive force can result in uncontrolled bursting of the container and the erratic splattering and forceful discharge of the contents. The discharge of the flavoring syrup from the packet in a sudden surge also can create problems in achieving a good mix of the flavoring constituent with the base liquid of the drink, which typically is carbonated water that must be dispensed over a period of time, such as 4 to 6 seconds, in order to fill a serving cup. Sudden discharge of the flavoring constituent contents from a packet early in the dispensing cycle for the carbonated water can result in the bottom of the dispensed beverage being substantially undiluted syrup and the top of the beverage being essentially carbonated water. If the packet ruptures late in the carbonated water dispensing cycle, the reverse situation occurs. Moreover, the forceful discharge of the flavoring constituent from the packet into the serving cup after it is nearly filled with carbonated water can cause excessive foaming of the dispensed drink and overflowing from the cup.

In order to reduce the force necessary to effect rupturing of the flavoring constituent containing packet, it has been proposed to provide a weakened section in the peripheral seal of the packet. However, it has been difficult to match the proper force applied to the packet during dispensing of the beverage and the yielding strength of the weakened seal, with the result that such weakened seals tend to quickly open, again resulting in the sudden and quick expulsion of contents from the packet. Moreover, if the seal of the packet is made to yield too easily, accidental rupturing can occur during shipping and handling of the packet. In that event, sticky syrup from one accidentally ruptured packet can contaminate an entire shipping carton of packets.

It is an object of the present invention to provide an improved flexible-walled container or packet formed with a peripheral seal adapted for easy and reliable rupturing at a desired location by the application of external pressure to the side walls of the container. A related object is to provide such a flexible-walled container that is particularly adapted for use in containing and dispensing a measured quantity of a flavoring constituent in a packet type of automated beverage dispensing system.

Another object is to provide such a flexible-walled container or packet as characterized above which permits relatively high pressures to be exerted on the packet to effect reliable opening, but which prevents the discharge of the contents of the packet in a sudden surge.

A further another object is to provide a flexible-walled container of the foregoing type which is adapted for controlling the discharge of contents over a predetermined period, corresponding to the period of the dispensing cycle of carbonated water directed into a drink in an automated beverage dispensing system with which the container is used.

Yet another object is to provide a flexible-walled container of the above kind that is adapted to more reliably withstand normal pressures occurred during handling and shippage and which resists accidental rupturing.

Still a further object is to provide such a flexible-walled container of the foregoing type which has sufficient rigidity to permit positioning of the container in a beverage dispensing unit with the discharge end of the container maintained in properly oriented condition.

Other objects and advantages of the invention will become apparent upon reading the following detailed description and upon reference to the drawings, in which:

FIG. 1 is a plan view of an illustrated container embodying the present invention;

FIG. 2 is a vertical section of the container shown in FIG. 1, taken in the plane of line 2—2;

FIG. 3 is a section illustrating a portion of the container in partially manufactured condition; and FIG. 4 is an enlarged fragmentary section diagrammatically illustrating the discharge end of the packet as external pressure is applied thereto during dispensing or rupturing the seal to the discharge spout.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to FIGS. 1 and 2 of the drawings, there is shown an illustrative container or packet 10 embodying the invention, comprising two layers or walls 11 of flexible sheet material of similar size and shape, preferably rectangular in form. It will be appreciated that the choice of sheet material is determined by the nature of the substance to be packaged in the container. The sheet material must be impermeable to the contents and have adequate strength to prevent tearing or puncturing when subjected to reasonable use. When containing a flavoring constituent for use in a carbonated beverage, or other food substance, the sheet material must be inert to the substance contained and be acceptable under sanitary codes. The sheet material preferably is a heat sealable plastic film of either single ply or multi-ply construction, and the film may be laminated to other materials, such as paper or foil. If the flexible sheet material consists of more than one layer, the inner layer preferably is a heat sealable thermoplastic.

For forming an internal sealed compartment 12 within the container 10, the peripheral edges of the walls 11 are sealed along marginal side areas 14, 15, a marginal upper end area 16, and a marginal lower or discharge end area 18. The seals preferably are formed by heat sealing, but an adhesive may be used if desired. Although the illustrated container 10 is sealed about its entire perimeter, alternatively, the container could be formed by folding a single sheet of flexible material over itself and sealing three marginal edges or sides of the container, the fourth side being the fold. Similarly, the container could be formed from a seamless tube that is sealed at opposed ends. In any event, the container is sealed such that the compartment is fluid tight so that when external pressure is applied to the walls of the container, an internal pressure corresponding substantially to the external pressure is developed within the container.

In the illustrated embodiment, the side marginal seal areas 14, 15 and the upper seal area 16 join the walls 11 of the container with a relatively strong permanent bond. In forming such seals, heat and pressure preferably are applied to the marginal areas of the walls in a manner that creates a textured pattern of indentations in the sheet materials, such as shown by the two directional cross hatch lines in FIG. 1. It will be understood that the textured pattern may be in the form of a dot pattern, cross hatch pattern, or the like. Such textured, relatively permanent sealed marginal areas 14–16 create reliable fluid tight bonding of the walls 11 of the container even if slight wrinkles exist in the material. In addition, the textured marginal seal areas 14–16 stiffen the perimeter of the packet, providing sufficient rigidity to the packet to facilitate handling of the packet and to permit proper positioning of the packet in a beverage dispensing unit, such as shown in the aforementioned application Ser. No. 014,927.

The marginal sealed area 18 at the lower or discharge end of the packet 10 includes similar textured relatively strong or permanently sealed areas 20, again shown by two directional cross hatch lines. The marginal sealed areas 20 define an unsealed discharge spout 21 located on the longitudinal axis of the packet at the lower end thereof. The discharge spout 21 in this instance includes a narrow width spout area with parallel sides **21*a* extending inwardly from the bottom peripheral edge of the packet and a flow channeling area with outwardly flared sides 21*b* extending inwardly therefrom. The textured nature of the hard sealed areas 20 again provides rigidity to the lower discharge end of the packet to facilitate proper positioning of the packet into an automated dispensing unit, and the configuration of the spout 21** is adapted for directing the discharge from the packet, as will become apparent.

In accordance with an important aspect of the invention, an arcuate-shaped, relatively weakly sealed area is formed in surrounding relation about the discharge spout of the container for defining an unsealed chamber that communicates with the discharge spout. To this end, in the illustrated embodiment, an arcuate-shaped, relatively weakly sealed area 25 is formed which has a generally horseshoe or U-shaped configuration connecting between the permanently sealed areas 20 to define an unsealed chamber 26 having an inwardly extending, arcuate-shaped side **25*a* directly above the discharge spout 21 and a similar arcuate side 25*b* which defines the central, lower end of the sealed compartment 12. The relatively weakly sealed area 25 can be formed by sealing the walls 11 of the packet at a lower temperature than the heat seal used for the permanently sealed marginal areas 14–16 and without the indentation texturing of the permanently sealed areas. It will be understood by one skilled in the art that by proper control of the sealing temperature for the arcuate shaped weakly sealed area 25, the walls 11 of the container can be bonded in a yieldable, fluid tight relationship, which permits pealing apart of the joined walls and opening or rupturing of the sealed area 25 upon the application of sufficient internal pressure within the container. To ensure against possible unsealed gaps between the permanently sealed areas 20 and the arcuate shaped sealed area 25, the arcuate shaped sealed area 25 preferably is formed with leg portions 28 extending outwardly from opposed sides thereof (as shown in FIG. 3) and the permanently sealed areas 20 are then formed in overlapping relation with such leg portions 28, as shown in FIG. 1**.

Because of the arcuate shape of the weakly sealed area 25, it has been found that upon the application of external pressure to the packet 10, such as applied in an automatic beverage dispensing unit, the internal pressure build up within the packet will distribute substantially uniformly around arcuate side 25b of the seal, as diagrammatically depicted by the arrows in FIG. 1. As a result, the relatively weakly sealed area 25 will withstand greater pressure before the seal yields, than, for example, in the case of a seal having a V-shape or square configuration with corners which tend to create high points of stress concentration. Hence, the arcuate weakly sealed area 25 has been found to be less susceptible to accidental yielding during handling and shippage of the container. In addition, greater forces may be employed in the automatic dispensing of the contents from the packet, such as in an automated packet type beverage dispensing system, to effect assured opening of the packet without premature rupturing of the seal.

When the packet is utilized in an automatic dispensing apparatus such as shown in the above-identified related application Ser. No. 014,927, pressure is progressively applied to the packet from top to bottom forcing the contents in a downward direction. This, in turn, tends to cause a ballooning of the lowermost portion of the packet about the arcuate shaped seal, as diagrammatically indicated in FIG. 4. The forces f acting on the walls of the container in such condition have vertical components f1 and horizontal components f2, the horizontal components f2 being directed in opposed relation causing the walls of the packet to be pulled apart at the location of the arcuate seal 25 so as to be achieve reliable yielding. Since the packet will balloon more at the centrally located arcuate seal 25, then at the bottom marginal sealed areas 20 outwardly therefrom, greater opening forces are exerted on the arcuate seal, than on the bottom marginal sealed areas, which further enhances reliable opening of the arcuate seal in the automatic dispensing unit. On the other hand, when a plurality of such packets are laid upon each other in a shipping carton, there is less tendancy for the lower portion of the container to balloon, and hence, less tendancy for accidental rupturing of the arcuate seal.

In accordance with a further aspect of the invention, a relatively strong or permanently sealed diverter area 30 is provided in the chamber defined by the arcuate shaped sealed area 25 and the discharge spout 21 for metering the expulsion of the contents through the discharge spout in a controlled fashion upon yielding of the weakly sealed arcuate seal area 25, even when the packet is subjected to relatively high pressures in an automated dispensing unit. In the illustrated embodiment, the diverter area 30 is in the form of a dot which has a relatively small diameter circular configuration disposed centrally within the unsealed areas defined by the arcuate sealed area 25 and the discharge spout 21 on the longitudinal axis of the packet directly above the discharge spout 21. The diverter dot 30 preferably is formed with sufficient heat and pressure that a relatively strong and permanent bond is created between the walls 11 of the container at such location. The illustrated diverter dot 30 has a diameter of about ½ the width w of the discharge spout 21 and is located within the unsealed area so as not to unduly restrict or impede the flow of contents into the narrow wall portion 21a of the discharge spout on yielding of the arcuate sealed area 25. The diverter dot 30 preferably is positioned such that an innermost peripheral edge 30a thereof is substantially in line with inner most peripheral sides 20a of the permanently sealed areas 20 such that upon yielding of the arcuate weakly sealed area 25 the internal pressures within the container are distributed along the inner peripheral sides 20a of the sealed areas 20 and are not concentrated on the diverter dot 30 in a manner which might cause its accidental yielding.

In use of the container 10 in a packet type automated beverage dispensing system, it has been found that even when high actuating pressures are applied to the packet for effecting assured yielding of the arcuate seal 25, the diverter dot 30 serves to restrict ballooning of the discharge spout 21 and tends to meter and control the expulsion of the contents from the packet through the discharge spout so as to prevent the sudden surge and forceful discharge of the contents. As the arcuate seal 25 yields, the flow of the contents from the compartment 12 of the packet is first into the unsealed chamber 26 and then about the diverter dot 30 and through the discharge spout 21. The discharge is thereby controlled so as to occur over a defined period of time, which may be consistent with the dispensing cycle of carbonated water dispensed in an automated beverage dispensing system. Hence, a more uniformly mixed beverage may be dispensed. In addition, because the contents from the packet is not forcefully discharged into the drink, foaming of the dispensed beverage is minimized. It will be appreciated that by appropriate design of the size and location of the diverter dot 30 within the unsealed chamber, the time required for expelling the contents from the packet can be controlled within relatively precise parameters. It will further be appreciated that the size of the divertor dot and the discharge spout 21 may be varied depending upon the viscosity of the contents to be dispensed from the packet.

A further feature of the diverter area 30 is that it enables utilization of a larger discharge spout 21 than otherwise would be permitted in providing a metered discharge from the packet. In other words, without the diverter dot 30, the discharge spout 21 would have to be smaller in size in order to provide effective metering of the contents from the packet. Forming a relatively narrow unsealed discharge spout or passage by heat sealing techniques presents problems, however, since the heat from the sealing bars tends to migrate into the intended unsealed area, which can partially or completely restrict the spout area. Since the utilization of the diverter dot 30 enables a larger width discharge spout, the packet of the present invention can be more reliably produced without heat of migration adversely affecting the unsealed spout area.

The textured permanently sealed area 14–16 and 20, as previously indicated, provide the packet with a substantial degree of rigidity to facilitate handling and proper positioning in the dispensing unit of an automatic beverage dispensing unit. Moreover, one or more locating notches may be provided in the permanently sealed areas to guide the packet into proper position, or to cooperate with suitable sensing means which insure that the packet is properly located before the dispensing unit is actuated. In the illustrated embodiment, for example, the lower marginal seal areas 20 each are formed with a cut out area 32 at their outermost corners for such purpose.

From the foregoing, it can be seen that the flexible container of the present invention is particularly adapted for use in containing and dispensing a measured quantity of a flavoring constituent in a packet type of automated beverage dispensing system. The packet permits relatively high pressures to be exerted thereon to effect assured and reliable opening during dispensing, but prevents the contents of the packet from being discharged in a sudden surge by controlling the discharge over a predetermined period, such as a period corresponding to the dispensing cycle of the carbonated water that is to be dispensed into the drink. The arcuate shape of the weakly sealed area in combination with the permanently sealed diverter area further enables the packet to withstand normal pressures occurred during handling and shippage and resist accidental rupturing.

I claim as my invention:

1. A sealed container of the type which is ruptured to dispense a substance packaged therein comprising walls of flexible material having mating peripheral edges, means forming a seal along a marginal area of said edges to define a fluid-tight internal packaging compartment, said marginal area seal including relatively strong permanently sealed areas which define an unsealed discharge spout, an arcuate shaped relatively weakly sealed area bridging across said discharge spout for defining an unsealed chamber communication with said discharge spout, said arcuate shaped weakly sealed area having a curvalinear side defining a portion of the perimeter of said internal compartment and extending inwardly into said compartment from said marginal permanently sealed area whereby upon application of predetermined external pressure to the container said weakly sealed area will rupture about said curvalinear side to permit the discharge of the packaged substance through said unsealed chamber and discharge spout, and a sealed diverter area within the unsealed chamber defined by said arcuate seal and discharge spout for retaining the walls of said container together at said diverter area upon rupturing of said weakly sealed area and for metering the discharge of the packaged substance through said unsealed chamber and discharge spout.

2. The container of claim 1 in which said diverter area is in the form of a relatively small diameter circular dot.

3. The container of claim 2 in which said diverter dot has a diameter less than the width of said discharge spout.

4. The container of claim 3 in which said diverter dot has a diameter of about ½ the width of said discharge spout.

5. The container of claim 1 in which said discharge spout has a relatively narrow width spout section extending inwardly from the peripheral edge of said container and an outwardly flared flow channelling section extending inwardly therefrom.

6. The container of claim 1 in which said relatively strong permanently sealed areas are formed with a pattern of indentations for enhancing the bond between the walls of the flexible sheet material for providing said areas with a degree of form retaining rigidity.

7. The container of claim 6 in which said relatively strong permanently sealed areas define said discharge spout on the longitudinal axis of said container at a lower end thereof, and said relatively strong permanently sealed areas extend laterally from said discharge spout across the lower end of said container.

8. The container of claim 7 in which said relatively strong permanently sealed areas extend the length of the sides of said container and across the upper end thereof.

9. The container of claim 8 in which said relatively strong permanently sealed areas are formed with at least one container locating cutout section.

10. The container of claim 8 in which said relatively strong permanently sealed areas are formed with container locating cutout sections at each of the opposed bottom corners.

11. The container of claim 1 in which said curvalinear side of said weakly sealed area defines a central lower perimeter of said internal compartment.

12. The container of claim 11 in which said arcuate shaped weakly sealed area has a curvalinear lower side that defines an upper side of said unsealed chamber.

13. A sealed container of the type which is ruptured to dispense a substance packaged therein comprising walls of flexible material having mating peripheral edges, means forming a seal along a marginal area of said edges to define a fluid-tight internal packaging compartment, said marginal area seal including relatively strong permanently sealed areas which define an unsealed discharge spout, a relatively weakly sealed area sealing the discharge spout from the internal packaging compartment, said weakly sealed area extending inwardly into said compartment from said marginal area seal, a relatively strong permanently sealed diverter area in said unsealed discharge spout, whereby on the application of predetermined external pressure to the container said weakly sealed area ruptures to permit the controlled discharge of the packaged substance through said discharge spout with said permanently sealed diverter area retaining the walls of the container in joined relationship at the location of said diverter area for metering the discharge through the spout.

14. The container of claim 13 in which said diverter area is in the form of a relatively small diameter circular dot.

15. The container of claim 14 in which said diverter dot has a diameter less than the width of said discharge spout.

16. The container of claim 14 in which said discharge spout has a relatively narrow width spout section extending inwardly from the peripheral edge of said container and an outwardly flared flow channelling section extending inwardly therefrom.

17. The container of claim 16 in which said diverter dot has a diameter of less than the width of said relatively narrow width spout section.

18. The container of claim 17 in which said diverter dot has a diameter of about ½ of the width of said relatively narrow width spout section.

19. The container of claim 13 in which said relatively strong permanently sealed areas are formed with a pattern of indentations for enhancing the bond between the walls of the flexible sheet material and for providing said areas with a degree of form retaining rigidity.

20. The container of claim 13 in which said relatively strong permanently sealed areas define said discharge spout on the longitudinal axis of said container at a lower end thereof, and said relatively strong permanently sealed areas extend laterally from said discharge spout across the lower end of said container.

21. The container of claim 20 in which said relatively strong permanently sealed areas extending from said spout have uppermost sides which define a lower end of said internal packaging compartment, and said diverter area has an uppermost side substantially in alignment with said uppermost sides of said strong permanently sealed areas.

22. The container of claim 13 in which one side of said weakly sealed area had an arcuate shape with a curvalinear upper side that defines a central lower perimeter of said internal compartment.

23. The container of claim 22 in which said weakly sealed arcuate shaped area has a lower curvalinear side that defines an upper side of said unsealed chamber.

24. A sealed container of the type which is ruptured to dispense a substance packaged therein comprising walls of flexible material having mating peripheral edges, means forming a seal along a marginal area of said edges to define a fluid-tight internal packaging compartment, said marginal area seal defining an unsealed discharge spout, an arcuate shaped sealed area surrounding said discharge spout for closing said internal compartment from said discharge spout and for defining an unsealed chamber communicating with said discharge spout, said arcuate shaped sealed area has a first curvalinear side that extends inwardly into said compartment from said marginal area seal and defines a portion of the lower perimeter of said compartment and a second curvalinear side that defines an upper perimeter of said unsealed chamber, whereby upon application of predetermined external pressure to the container said arcuate shaped sealed area will rupture to permit the controlled discharge of the packaged substance through said unsealed chamber and discharge spout, and a sealed diverter area within the unsealed chamber defined by said arcuate seal and discharge spout for retaining the walls of said container together at said diverter area upon rupturing of said weakly sealed area and for metering the discharge of the packaged substance through said unsealed chamber and discharge spout.

25. The container of claim 24 in which said diverter area is in the form of a relatively small diameter circular dot.

26. The container of claim 24 in which said discharge spout has a relatively narrow width spout section extending inwardly from the peripheral edge of said container and an outwardly flared flow channelling section extending inwardly therefrom.

* * * * *